US006202974B1

(12) United States Patent
Rellinger

(10) Patent No.: US 6,202,974 B1
(45) Date of Patent: Mar. 20, 2001

(54) PORTABLE EASEL WITH ADJUSTABLE BOARD SUPPORT

(75) Inventor: Michael Rellinger, Chicago, IL (US)

(73) Assignee: General Binding Corporation, Quartet Mfg. Co. Divison, Skokie, IL (US)

( * ) Notice: Subject to any disclaimer, the term of this patent is extended or adjusted under 35 U.S.C. 154(b) by 0 days.

(21) Appl. No.: 09/050,136

(22) Filed: Mar. 30, 1998

(51) Int. Cl.[7] ..... A47B 97/04
(52) U.S. Cl. ..... 248/460; 248/165; 248/464
(58) Field of Search ..... 248/460, 463, 248/464, 462, 122.1, 125.1, 163.1, 165, 166, 159, 150, 155, 292.13, 316.2, 528, 230.1, 230.2, 230.7, 231.21, 231.81, 227.3, 227.4, 74.2

(56) References Cited

U.S. PATENT DOCUMENTS

| | | | | |
|---|---|---|---|---|
| 260,068 | * | 6/1882 | Van Kirk | 248/463 |
| 2,744,712 | * | 5/1956 | Brandt | 248/406 X |
| 2,973,933 | * | 3/1961 | Howell | 248/460 |
| 3,886,700 | * | 6/1975 | Lambert | 52/108 |
| 4,017,049 | * | 4/1977 | Albee, Jr. | 248/464 |
| 4,171,116 | * | 10/1979 | Carver et al. | 248/464 |
| 4,320,832 | * | 3/1982 | Edstrom | 206/228 |
| 4,326,687 | * | 4/1982 | Clyburn | 248/168 |
| 4,712,756 | * | 12/1987 | Kester et al. | 248/168 |
| 5,125,613 | * | 6/1992 | Albee, Jr. et al. | 248/464 |

* cited by examiner

*Primary Examiner*—Anita M. King
(74) *Attorney, Agent, or Firm*—Martin Faier; Faier & Faier P.C.

(57) ABSTRACT

A portable easel with adjustable board support which has a plurality of legs pivotally joined together by a head, the legs of which may be selectively spread apart when set up as an easel and folded together when collapsed, each leg composed of multiple interlocked sections biased together when in extended position but which may be manipulated for separation and folding into a bundle one section against another section for storage and transport, and a board support mounted on at least one leg which may be selectively adjustably moved to a desired position on any of the sections and moved against the leg on which it is mounted for storage and transport and extended away from the leg for holding a display on the easel when set up.

17 Claims, 2 Drawing Sheets

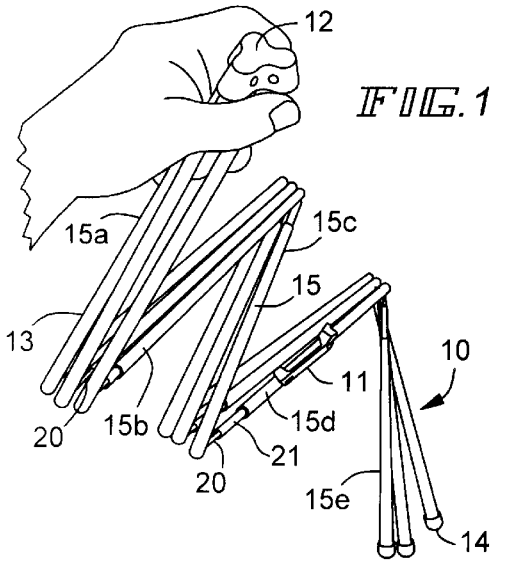
FIG. 1
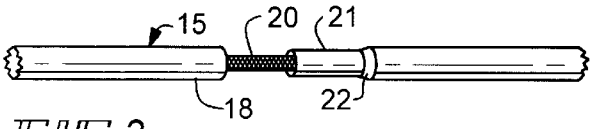
FIG. 3
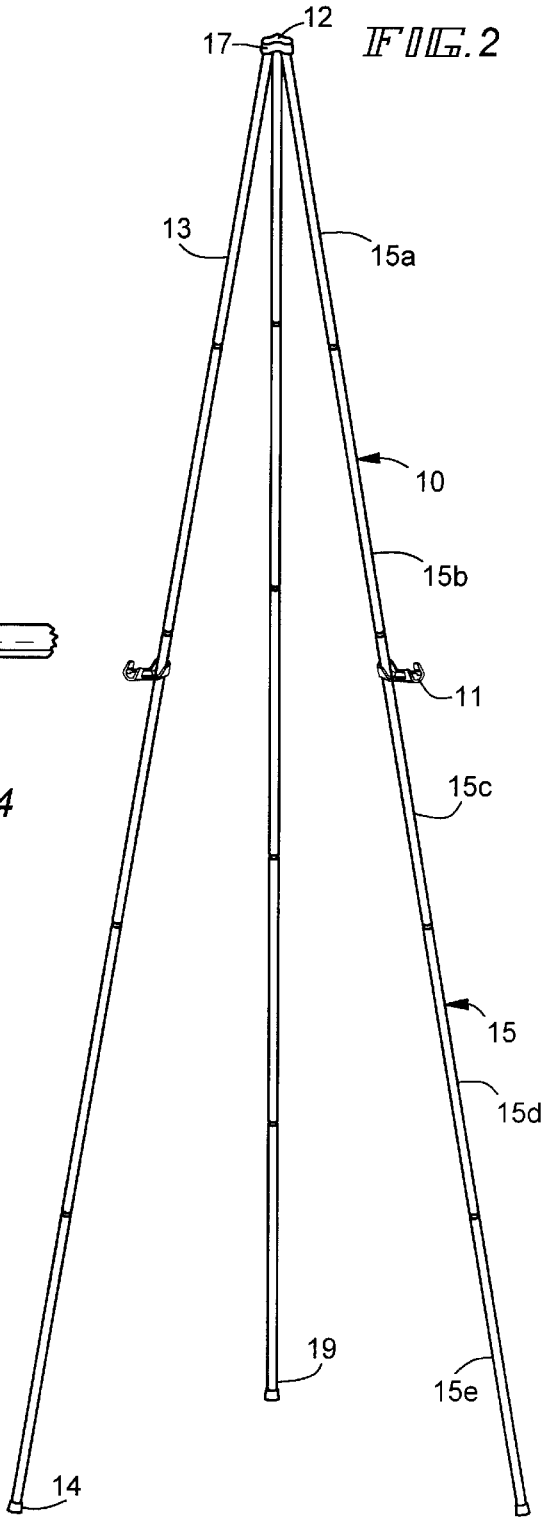
FIG. 2
FIG. 4
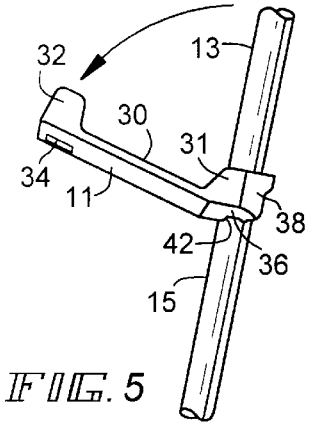
FIG. 5
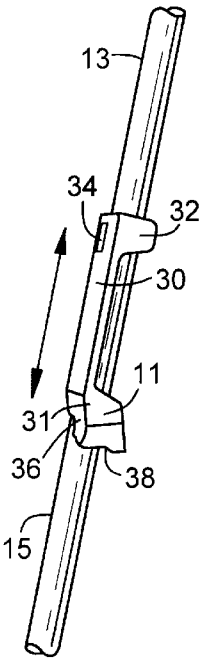

PORTABLE EASEL WITH ADJUSTABLE BOARD SUPPORT

This invention relates to a novel portable easel with an adjustable board support, and is more particularly concerned with such a display holding device which is easily and rapidly set up, is capable of adjustably securing a graphic display in a selected position, and which may be selectively quickly collapsed and set up again without special tools or capabilities and which may be conveniently stored and transported in minimum space.

BACKGROUND OF THE INVENTION

Conventional easels usually comprise a tripod or similar arrangement of legs comprised of telescoped tubes or foldable struts which may be extended linearly to a desired height and which have a display support platform across one or more of the tubes or struts, The tubes or struts are usually held in extended position by means of a thumb or set screw or screw collar or similar fastening means locking one tube or strut to the adjacent tube or strut. To collapse the tubes or struts, the thumb screw or screw collar is turned-and one tube is telescoped into an adjacent tube, or the struts are pivotally folded together.

Likewise, the display platform may be adjustable along the tubes or struts and conventionally secured at a desired height by conventional fastening means.

In all known prior art easels, some manipulation of screw-like or similar fastening members is required to lock the easel leg members together linearly. These fastening members require time, space and effort to selectively manipulate them for setting up or collapsing the easel. Frequently, it is necessary to remove the display support platform from the legs or to fold this support or move the support out of its desired display supporting position when collapsing the easel legs, and to reverse the procedure when setting up the easel. Often the display supporting platform must be moved to a selected height when the easel is again set up for use. Usually, the collapsed conventional easel is too bulky to permit it to be carried and stored conveniently, for example, no known full height easel can be carried in a conventional brief case.

SUMMARY OF THE INVENTION

In the present invention, a plurality of sets of tubes or legs (usually preferably three sets) are pivotally connected together at one end or the head of the easel tripod. These sets may be pivotally spread apart, with one end of each set secured to the tripod, to form legs for the easel. Usually, the head includes means for limiting the spread of the legs. Each set of tubes comprises a tripod leg, and each leg is made up of several interlocked sections, preferably telescoped together. Each telescopic section has an end of reduced diameter, and that reduced diameter end is fit interlocked into the other end of the adjacent section.

Within the tubes of each leg is a bungee cord like elastic rope, connected at one end near the tripod head to its adjacent uppermost section and at the other end near the foot of the leg on the last tubular section in the set remote from the head. This elastic rope is under tension, tending to pull the tubular sections together, but still allowing them to be pulled apart by hand manipulative force. When the tubes are folded side to side, the sets are compact and the tube section are not arranged linearly and are separated from one another, forming a bundle of side to side sections. When the tripod head is held and the legs are allowed to fall or shaken in a downward direction, the elastic rope allows each section to swing free and be drawn together telescopically, with the reduced diameter end of one section being drawn home into the open end of the adjacent tube.

A pair of novel display board holders or supports are arranged preferably one each on two of the three tripod legs. This support has two positions: one extended from the leg on which is mounted or a second position folded against the leg on which it is mounted. When extended, the support is locked into position on its leg, and the support is capable of holding a display spanning both like supports at a selected height. When folded, the support is not only compactly arranged and folded against the leg, but also it may be slid along the section of the leg on which it is mounted or onto an adjacent section into another selected position, to the full height of the leg, so that display boards of selected various heights may be handled. These locking, binding and sliding positions for the support depend upon whether nubs or projections on the support engage the leg. The adjacent legs sections must be of a constant diameter to permit the support to be moved upwardly or downwardly from interlocked section to the adjacent section of the leg.

OBJECTS AND ADVANTAGES OF THE INVENTION

It is the object of the present invention to provide a portable easel with an adjustable board support of the character described.

Another object of the invention is to provide a portable easel composed of interlocked telescoped tubular sections urged together by elastic means.

Another object is to provide a portable easel composed of multiple legs and a cooperating adjustable display support, each leg having co-planar sections which may be selectively interlocking or collapsed, each section having a surface for adjustably moving the display support from section to section.

Another object is to provide a tripod type easel having an adjustable display support, wherein an elastic cord is secured to its legs at its tripod end and at the end of the easel remote from its tripod end within multiple interlocking tubular sections normally urged into tensioned interlocking engagement but which can be separated and folded against one another when not in interlocking engagement.

Another object is to provide a tripod type collapsible easel having an adjustable display support which is composed of folded multiple sections joined together by an elastic cord, which may be set up by manipulation of its tripod to arrange the sections in linearly interlocked extended position.

Another object is to provide a tripod type collapsible easel having a plurality of legs each consisting of interlocked members and having a display support arranged on one or more of the interlocked members, wherein the display support may be pivotally folded away from a leg for supporting a display on the easel and pivotally folded against the leg for adjustment of the height of the display support along the leg and for transport and storage.

Another object is to provide a display support for a tripod type collapsible easel which has nubs to selectively secure the display support in an extended position for mounting a display on the support or in a folded position when collapsing the easel or adjusting the height of the support on the easel.

It is also the object to provide a novel easel having an adjustable display board support which is simple and easy to efficiently manufacture, assemble, ship, set up, collapse, transport, store, use and reuse, without special tools or knowledge.

These and other objects and advantages of the invention will become more apparent as this description proceeds, taken in conjunction with the accompanying drawings.

BRIEF DESCRIPTION OF THE DRAWINGS

In the drawings:

FIG. 1 is a perspective view of the easel embodying the present invention showing the easel as it is being set up by unfolding of its sections.

FIG. 2 is a perspective view of the set up easel embodying the present invention.

FIG. 3 is a detailed view showing the interlocking telescopic arrangement of typical tubular leg sections of the easel and the elastic cord shown within the sections.

FIG. 4 is a detailed perspective view showing the adjustable board support folded against a tubular leg section.

FIG. 5 is a detailed perspective view showing the board support folded away from the tubular leg section.

DESCRIPTION OF A PREFERRED EMBODIMENT

Figure 6:
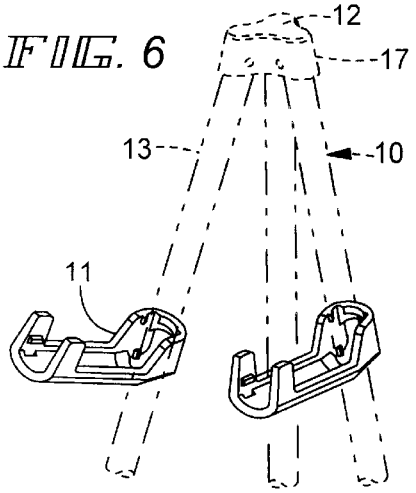
FIG. 6 is a detailed perspective view of a pair of board supports in an extended position showing the supports arranged on the easel legs, which are depicted in broken lines.

With reference to the accompanying drawings, and particularly to FIGS. 1–2, the portable easel 10 with its adjustable board support 11 embodying the present invention comprises a tripod head 12 which has extending from it several legs 13, preferably three, and a foot 14 which may be installed on each of the legs.

Each of the legs 13 comprise multiple interlocked telescopic sections 15. Each leg 13 preferably is pivotally secured to the head 12 by a rivet 16. The leg 13 can pivot from a position where the legs are aligned side by side to a position where the legs are spread to the position shown in FIG. 2, limited by the wall 17 of the tripod head 12.

Except for the upper leg section 15*a* one end of which is pivotally secured to the head 12, each of the other sections 15*b*–15*e* has one end 21 which has a reduced diameter and shoulder stop 22 so it will telescope into the other end 18 of each respective adjoining sections 15*a*–15*d*. The extreme or bottom end 19 of each section 15*e* remote from the head 12 carries the foot 14 to complete each of the legs 13.

Figure 12:
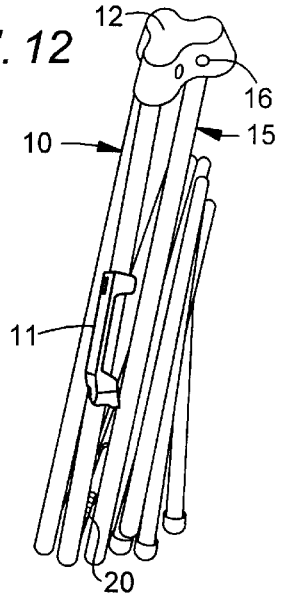
FIG. 12 illustrates the novel easel in folded and bundled condition.
Figure 7:
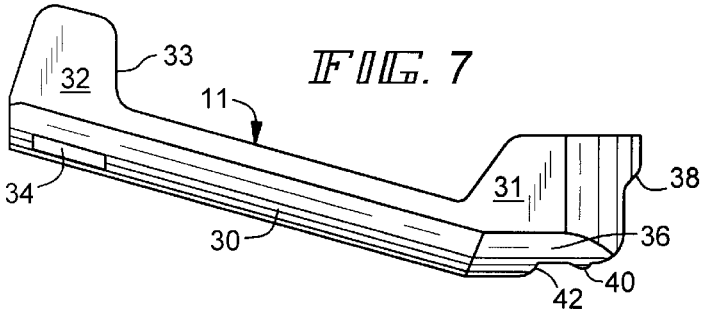
FIG. 7 is an perspective view of the board support.
Figure 9:
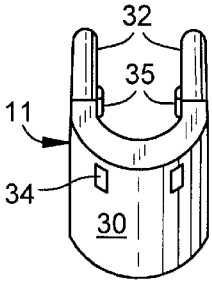
FIG. 9 is an end view of one end the board support.
Figure 8:
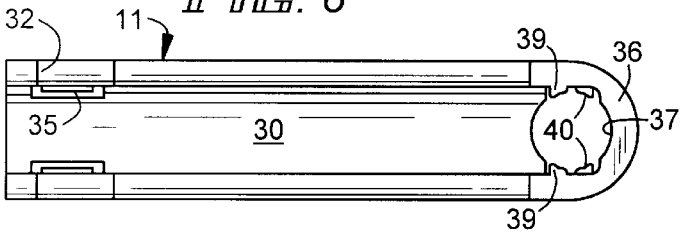
FIG. 8 is a top plan view of the board support.
Figure 10:
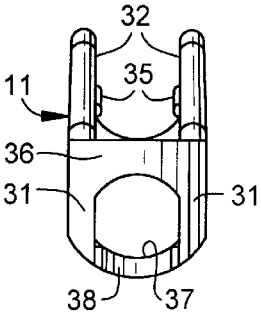
FIG. 10 is an end view of one end of the board support remote from the end shown in FIG. 9.
Figure 11:
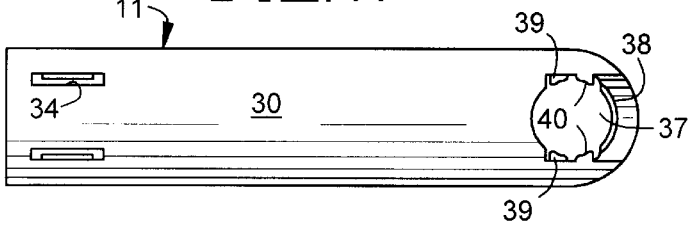
FIG. 11 is a bottom plan view of the board support.

Arranged within each leg 13 is a elastic cord 20, one end of which is anchored in the upper section 15*a* at the head 12 and the other end of which is anchored to the lower leg section 15*e*. This elastic cord 20 is under tension drawing the sections 15*a*–15*e* telescoped nested together, but the tension is limited so that by hand manipulation, the sections 15*a*–15*e* may be disengaged, as shown in FIGS. 1 and 3, and folded so that the sections 15 may be arranged in a side by side position in the manner shown in FIG. 1 and fully bundled as shown in FIG. 12.

When folded so that the sections 15 are side by side, the collapsed easel is compact and may be easily placed into a brief case for storage and transport. To erect the easel 10, it is necessary only to hold the tripod head 12 and shake the sections 15, in the manner shown in FIG. 1, where they are telescopically drawn together as extended legs 13 and these legs are pivoted outwardly on the head 12 into the position shown in FIG. 2.

A board support 11 is preferably mounted on two of the three legs 13. Each board support 11 has two positions, one where it is folded against the leg 13 on which it is mounted, as shown in FIG. 4, and one where it is folded away from the leg as shown in FIGS. 2 and 5. When folded against its leg 13, the support 11 may be moved upwardly or downwardly along all of the sections 15*a*–15*e* of the leg 13 on which it is mounted in the direction of the arrow in FIG. 4, the sections being of the same constant diameter and smooth and unencumbered when nested telescoped together, as described. When extended from its leg 13 in the direction of the arrow in FIG. 5, the support 11 is bound in place and will not move, except under substantial pressure, so that it can support a display mounted on it, and the display may be leaned against the leg 13 on which the support is mounted. When in folded position as shown in FIG. 4, the support will not inhibit folding of the sections side by side into a compact assembly for storage and transport as previously described.

This support 11 comprises a channel-like structure as shown in FIGS. 6–11, which preferably may be molded from thermoplastic material. This channel-like structure has a bottom wall 30 and spaced apart upstanding walls 31 sized substantially configured to the leg sections 15. At one end of the support 11 there are a pair of spaced apart upstanding ears 32, each having a trailing wall 33 intended to prevent a display from slipping off of the support when extended as shown in FIG. 6. These ears 32 are flexible and together with the cut-outs 34 in the bottom wall 30 adjacent each of the ears as well as inwardly extending nubs 35 on each ear permits each ear to spread slightly and to snap-engage the leg 13 when the support is folded against the leg. The end of the support remote from the ears 32 has a base 36 extending upwardly and angularly disposed from the channel bottom wall 30 and an aperture 37 sized to loosely fit over the leg sections 15. At opposed positions on the upstanding walls 31, base 36 extending into this aperture 37 are two sets of projections, an upper pair 39 and a lower pair 40. The lower rear wall 38 of the base 36 is cut out to permit folding of the support 11 upwardly against its leg 13. These projections 39 and 40 each snap-engage the leg 13 when the support 1I1 is folded fully down to maintain the support in display holding position. The upper wall 38 and lower wall 42 of the base aperture secure the support 11 in rigid position to hold a display. While a preferred embodiment of the invention has been disclosed, many modifications and changes in the structure may be made without departing from the spirit or scope of the invention. Accordingly, it is not desired that the invention should be limited to the exact construction disclosed.

I claim:

1. A portable easel having a board support for holding a display, said easel comprising a plurality of legs selectively spreadable apart when set up as an easel and foldable together when collapsed, and said board support mounted on at least one of said legs, said board support being selectively adjustably movable to a desired position on at least said one of said legs and extendable away from said leg for supporting a display on said easel, said board support comprising an apertured body through which said one leg extends, said body having a longitudinal channel, a base angularly disposed from said channel and upstanding members at each end of said channel, a first of said upstanding members having means to inhibit said display placed upon said support from moving off of said support, and a second of said upstanding members remote from said first of said upstanding member consisting of a clip for securing said support against said leg when folded toward said leg.

2. The portable easel recited in claim 1, wherein said second set upstanding member extends from said base.

3. The portable easel recited in claim 2, wherein projection means on said second of said upstanding members are adapted to snap engage said leg when extended into display holding position.

4. The portable easel in accordance with claim 1, wherein said clip of said board support comprises nubs which snap engage with said leg.

5. A portable easel having a board support for holding a display, said easel comprising at least three legs, a head arranged on and pivotally connecting one end of each of said legs, said legs being selectively spreadable apart when set up as an easel and foldable together when collapsed, each of said legs composed of multiple sections biased together when in extended position but which may be manipulated for separation and folding one section against another section for storage and transport, and said board support mounted on at least one of said legs, said board support being selectively adjustably moveable to a desired position on any of said sections on and along the entire length of said easel except at said head, said board support being selectively foldable against said leg on which said board support is mounted for storage and transport and folded away from said leg for holding a display on said easel when set up, said legs when spread apart as an easel adapted to leaningly hold said display against at least said one leg on which said board support is mounted.

6. The portable easel recited in claim 5, wherein said leg sections comprise telescopic tubes adapted for nesting one tube into another tube.

7. The portable easel recited in claim 6, wherein said leg sections are biased together by means of an elastic cord secured in said tubular legs.

8. The portable easel recited in claim 5, wherein at least one of said sections has an end of reduced diameter sized to fit nested into the open end of another of said sections.

9. The portable easel recited in claim 8, wherein said end of reduced diameter has a stop to limit unintended entry of said section into said other section.

10. The portable easel recited in claim 5, wherein each of said section of each of said legs further comprises tensioning means for drawing the sections of each of said legs together and including an elastic cord engaged under tension in said leg which urges said sections to bias together.

11. The portable easel recited in claim 10, wherein said sections are separable by hand manipulation of the sections pulled apart one section from the adjacent section.

12. The portable easel recited in claim 11, wherein said cord is stretchable sufficiently to permit said sections to be bundled side by side.

13. A The portable easel recited in claim 10, wherein said cord is anchored at each end of said leg.

14. The portable easel recited in claim 5, wherein said sections of one of said plurality of legs are each of the same diameter when nested together.

15. The portable easel recited in claim 5, wherein said board support has an aperture and said one leg extends through said aperture.

16. The portable easel recited in claim 5, wherein said head is arranged at the top of said easel and has a wall which limits spreading apart of said legs, but which permits spreading apart of two of said legs a distance greater or less than another of said legs, thereby pennitting tilting of said easel.

17. A portable easel having a board support for holding a display, said easel comprising at least three legs, a head arranged on and pivotally connecting one end of each of said legs, said legs being selectively spreadable apart when set up as an easel and foldable together when collapsed, each of said legs composed of multiple sections biased together when in extended position but which may be manipulated for separation and folding one section against another section for storage and transport, leg sections on each of said legs being manipulative angularly relative to an adjacent section on said leg and foldable angularly thereto, whereby the height of said easel may be varied, and said board support mounted on at least one of said legs, said board support being selectively adjustably moveable to a desired position on any of said sections on and along the entire length of said easel except at said head, said legs when spread apart as an easel adapted to leaningly hold said display against at least said one leg on which said board support is mounted.

* * * * *